US005823706A

United States Patent [19]

Hoare et al.

[11] Patent Number: 5,823,706

[45] Date of Patent: Oct. 20, 1998

[54] PAVEMENTS

[75] Inventors: David J Hoare; Imad M Alobaidi; Gurmel Singh Ghataora, all of Birmingham, Great Britain

[73] Assignee: The University of Birmingham, Birmingham, Great Britain

[21] Appl. No.: 586,905

[22] PCT Filed: Jul. 26, 1994

[86] PCT No.: PCT/GB94/01603

§ 371 Date: Apr. 10, 1996

§ 102(e) Date: Apr. 10, 1996

[87] PCT Pub. No.: WO95/04190

PCT Pub. Date: Feb. 9, 1995

[30] Foreign Application Priority Data

| | | | |
|---|---|---|---|
| Jul. 27, 1993 | [GB] | United Kingdom | 9315514 |
| Mar. 23, 1994 | [GB] | United Kingdom | 9405777 |

[51] Int. Cl.[6] ..... E01B 9/68; E01C 3/06

[52] U.S. Cl. ..... 404/28; 404/31; 404/82; 428/304.4

[58] Field of Search ..... 404/18, 27, 28, 404/31, 82; 238/2, 382, 283; 428/304.4, 309.9

[56] References Cited

U.S. PATENT DOCUMENTS

| | | | |
|---|---|---|---|
| 3,832,263 | 8/1974 | Cleveland . | |
| 4,235,371 | 11/1980 | Kohler | 404/31 X |
| 4,720,043 | 1/1988 | Ortwein | 238/2 |

FOREIGN PATENT DOCUMENTS

| | | | |
|---|---|---|---|
| 2030559 | 11/1970 | France . | |
| 0312102 | 12/1989 | Japan | 404/31 |
| 513302 | 9/1971 | Switzerland . | |
| 1355373 | 6/1974 | United Kingdom . | |
| 91/14828 | 10/1991 | WIPO . | |

OTHER PUBLICATIONS

Translation of Swiss Patent Document No. 513302, Nov. 15, 1971.

Translation of French Patent Document No. 2030559, Nov. 13, 1970.

*Primary Examiner*—James Lisehora

*Attorney, Agent, or Firm*—Jacobson, Price, Holman & Stern, PLLC

[57] ABSTRACT

A highway pavement has a multi-layer structure (20) interposed between the subbase (24) and the subgrade (22). The multi-layer structure is also suitable for use in railway pavements. The multi-layer structure (20) comprises upper and lower flexible sheet materials (14; 10) and an intermediate load-spreading layer formed of a multiplicity of load-spreading elements (12) held together in the desired preset relationship so that gaps are provided between adjacent elements (12) for passage of water. The upper flexible sheet material (14) is water permeable. The lower flexible sheet material (10) is either (a) substantially water impermeable but provided with perforations (16) or slits therethrough at locations which open into the gaps between the load-spreading elements (12), or (b) water vapour permeable but substantially impermeable to liquid water, or (c) substantially impermeable to liquid water and water vapour. In some embodiments the upper sheet material (14) may be omitted.

10 Claims, 2 Drawing Sheets

PAVEMENTS

Figure 1:
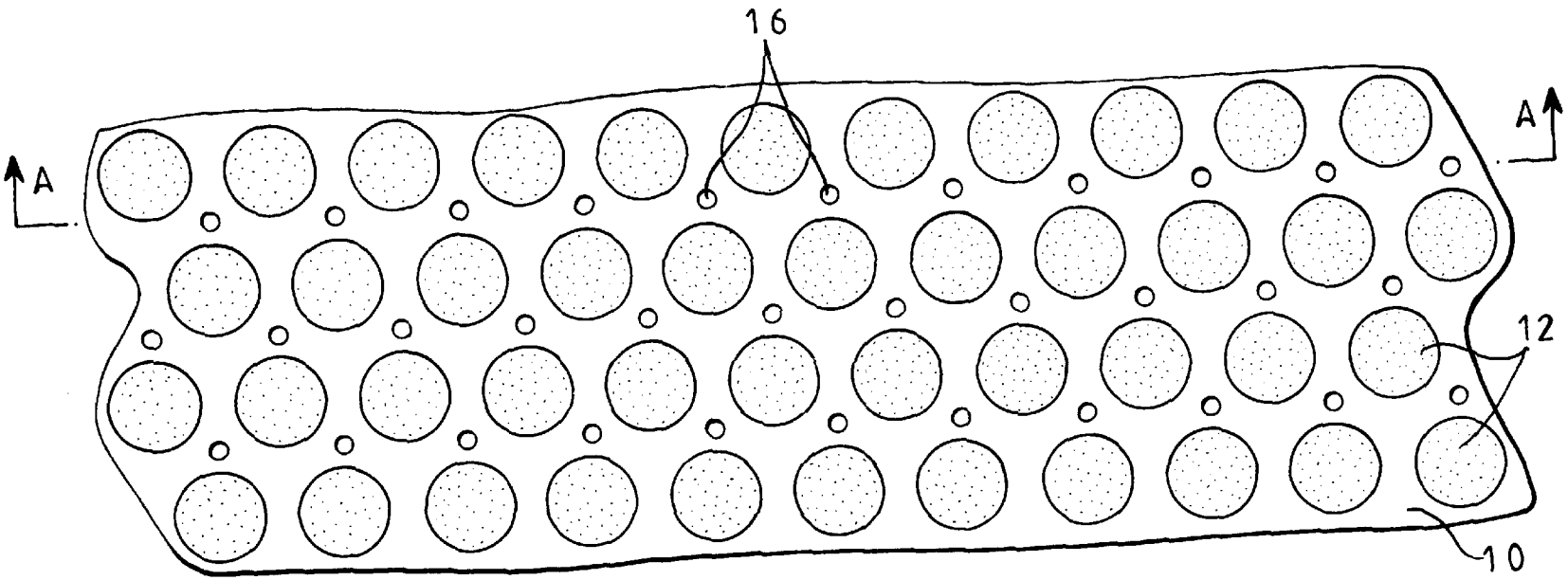

This invention relates to pavements generally and is particularly, but not exclusively, concerned with highway and railway pavements. By "pavement" is meant any surface which is laid on the ground and which is intended to bear loads, in particular cyclic/dynamic loads, in service.

In highway pavements, a layer of a graded granular material (commonly known as a subbase) forming part of the pavement construction is usually placed on top of the natural soil (commonly known as the subgrade) to spread the stress that is transmitted through upper layers of the pavement over the subgrade surface to a permissible value, to act as an isolating layer to protect the subgrade soil from frost action, and to provide a working platform for construction of the upper layers of the pavement. In order to fulfil these functions, the subbase must operate under drained conditions. When it is not clean (i.e, when it contains a large quantity of fines), undrained conditions develop which ultimately lead to a failure to perform acceptably. It is therefore necessary to protect the subbase/ballast during its lifetime from contamination by soil fines. Contamination by soil fines can occur as a result of "pumping" of fines from the underlying subgrade into the subbase and the sinking of subbase particles into the subgrade usually occurs when the following combination of conditions arise:

(1) The subgrade is cohesive, (2) The pavement layer above the subgrade (typically the unbound granular subbase) lacks fine particles (medium to fine sand), (3) Free water exists at the subgrade/subbase interface and/or sufficient water is contained within the subgrade material, and (4) The pavement is subjected to cyclic/dynamic loading.

The result of this is to reduce the efficiency of the subbase and cause the stress which is transmitted to the subgrade to increase, with a consequent reduction in the performance of the pavement.

In railway pavements, an essentially similar situation arises with open-graded railway ballast.

In order to prevent the pumping of fines, it is known to employ a layer of sand as a separator between the subgrade and the subbase/ballast. Although the sand layer appears to work efficiently in separating the two layers, it is sometimes inconvenient to use where there is a lack of local availability of sand, skilled labour is needed for placement, difficulties arise in the control of the thickness of the layer of sand and the occasional mixing with underlying cohesive subbase/ballast. Thus, the use of sand is an expensive and time-consuming operation. Attempts have also been made to prevent the pumping of fines into the subbase by the use of a textile sheet material to act as a separator. The advantages of these materials are that they are light in weight so that transport is not a problem, they are easy to place without the need for skilled labour and they are less expensive than sand. Such textile sheet materials act efficiently in preventing the coarse aggregates of the subbase/ballast layer from penetrating the cohesive subgrade. However, their action in the reverse direction (namely to stop migration of the fines from penetrating the coarse aggregate subbase/ballast) is doubtful. It is believed that, with existing textile sheet materials, success in preventing "pumping" of fines into the subbase/ballast has been achieved only with certain types of subgrades which contain relatively high percentages of sand or where the upper sub-layers of the pavement are well graded with a high percentage of sand.

It is therefore an object of the present invention to obviate or mitigate the problem of "pumping" of fines into the subbase/ballast even in cases where the subgrade is cohesive and the upper layers of the pavement are of less than ideal composition in terms of grading and sand content.

In one of its aspects, the present invention resides in the use of a multi-layer structure at the interface between the pavement subbase/ballast and the subgrade, said multi-layer structure comprising upper and lower flexible sheet materials and an intermediate load-spreading layer between the upper and lower sheet materials, the load-spreading layer including a multiplicity of load-spreading elements which are held together in a preset arrangement so that gaps are provided between adjacent load-spreading elements for passage of water and to permit the load-spreading layer to flex, the upper flexible sheet material being water permeable, and the lower flexible sheet material being (a) substantially water impermeable but provided with perforations or slits therethrough at locations which open into the gaps between the load-spreading elements, (b) water vapour permeable but substantially impermeable to liquid water, or (c) substantially impermeable to liquid water and water vapour.

In another aspect, the present invention resides in a method of constructing a pavement on a subgrade in which, prior to laying a subbase/ballast of the pavement, a multi-layer structure is provided on the subgrade, characterised in that the multi-layer structure is of the type defined in the last preceding paragraph.

In accordance with a further aspect of the present invention, there is provided a layer structure comprising a lower flexible sheet material having an intermediate load-spreading layer fixed thereto, said load-spreading layer being formed of a multiplicity of load-spreading elements which are held together in a preset arrangement so that gaps are provided between adjacent and load-spreading elements for passage of water and to permit the load-spreading layer to flex, and said lower flexible sheet material being (a) substantially water impermeable but provided with perforations or slits therethrough at locations which open into the gaps between the load-spreading elements, (b) water vapour permeable but substantially impermeable to liquid water, or (c) substantially impermeable to liquid water and water vapour.

The layer structure as defined in the last preceding paragraph will normally include an upper flexible sheet material which is fixed to the load-spreading layer and which is water permeable. However, it may be possible, under certain circumstances, to dispense completely with the upper flexible sheet material or, under other circumstances, to utilise an upper flexible sheet material which is water permeable but which may not be fixed to the load-spreading layer but merely laid over the latter during construction of the pavement.

The load-spreading elements preferably have an area which lies within the range of 20–500 $mm^2$, more preferably 75–315 $mm^2$, and most preferably about 110 to 185 $mm^2$. The size chosen for such load-spreading elements depends, inter alia, upon the size and shape of the granular material forming the subbase/ballast of the pavement, and this in turn depends upon the intended use of the pavement. The preferred area of 110 to 185 $mm^2$ relates to a highway pavement where the granular material forming the subbase is closely specified in terms of size, shape and grading in accordance with standard specifications for the material.

It is most preferred for the load-spreading elements to be substantially circular in plan view. For a highway pavement, such load-spreading elements most preferably have a diameter of about 13 mm and are preferably about 5 mm thick with a spacing between adjacent elements of about 5 mm.

However in some applications the element thickness may be in the range 2 to 5 mm and the element spacing may be in the range 2 to 5 mm. Moreover in some applications the elements may not be circular and may not be of constant thickness and in such arrangements references to diameter and thickness should be understood as equivalent diameter and equivalent thickness, respectively.

The load-spreading elements may be held together in the desired pre-set arrangement by being bonded or otherwise secured to the lower flexible sheet material. However, it is possible to hold the load-spreading elements together using flexible strands within the general plane of the load-spreading layer. In such an arrangement, it is possible to form the load-spreading elements and strands out of the same material. A convenient way of forming such a structure is to cut a multiplicity of apertures through a suitable sheet material so as to define the multiplicity of load-spreading elements which are interconnected by webs. Such sheet material can then be typically (but not exclusively) biaxially stretched so as to stretch the webs whereby to form the strands. Such stretching operation forms strands which are thinner than the load-spreading elements and therefore imparts the necessary flexibility to the strands whilst enabling the load-spreading elements to retain adequate stiffness as a result of their greater thickness. Such an arrangement of load-spreading elements with integral strands can be laid upon and preferably secured to the lower flexible sheet material at suitable locations to form the layer structure used in the present invention.

The thickness of the load-spreading elements depends upon the type of pavement into which the layer structure is to be incorporated. For a highway pavement, it is preferred for the thickness of the elements to be about 5 mm, although it is believed that a thickness of as little as 2 mm may be adequate for low stress applications and where the elements are formed of a relatively rigid material.

Most conveniently, the load-spreading elements are formed of a suitable resin material, for example, polyethylene, polypropylene or polyvinyl chloride. Likewise, the upper and lower flexible sheet materials may be formed of a suitable synthetic plastics material, such as polyethylene, polypropylene or polyvinyl chloride. In the case of the upper flexible sheet material, this is conveniently a woven or non-woven textile fabric.

In the case where the lower flexible sheet material is a type (a) material (i.e, substantially water-impermeable but provided with perforations or slits therethrough at locations which open into the gaps between the load-spreading elements), it will be appreciated that it is important to secure the load-spreading elements correctly with regard to the perforations or slits in the lower flexible sheet material. With such an arrangement, it is particularly preferred for the perforations or slits to be located as far as possible in the centres of the gaps between the load-spreading elements so that the perforations or slits do not extend to the load-spreading elements whereby there is a water impermeable region of the lower flexible sheet material around each of the load-spreading elements. Such an arrangement serves to minimise any local "pumping" of fines in use.

The type (a) lower flexible sheet material may be a continuous sheet formed by any standard sheet-forming technique so as to be substantially water-impermeable, with the perforations or slits being formed therethrough in a subsequent operation at the desired locations.

In the case where the lower flexible sheet material is a type (b) material (i.e, water vapour permeable but substantially impermeable to liquid water), such material might be a composite sheet formed of a pair of outer water permeable textile layers with an intervening water vapour permeable barrier layer e.g, a barrier layer formed of an unsintered sheet of polytetrafluoroethylene which is expanded so as to produce a fine microstructure characterised by nodes interconnected by fibrils (see for example GB 1355373).

In the case where the lower flexible sheet material is a type (c) material (i.e., substantially impermeable to liquid water and water vapour), the layer structure incorporating such flexible material—whilst it could be used in a wide variety of situations—is particularly suitable for use in situations where there is either no external water present or where it is desirable to prevent passage of water across the layer structure. Particular examples of this are on embankments or where the ground water table is well below the level of the layer structure and no long-term water movements upwards are anticipated. In cases where water movement downwards could occur through the pavement (such as rain, effluent from trains on railway tracks etc), such water can be kept away from the subgrade by being discharged transversely along or laterally through the layer structure.

In locations such as cuttings, or on level ground where there is a high water table, it is considered advisable to use a layer structure wherein the lower flexible sheet material is a type (a) or type (b) material.

The type (c) lower flexible sheet material may also be an extensible material and may be formed, for example, of rubber or neoprene.

Figure 2:
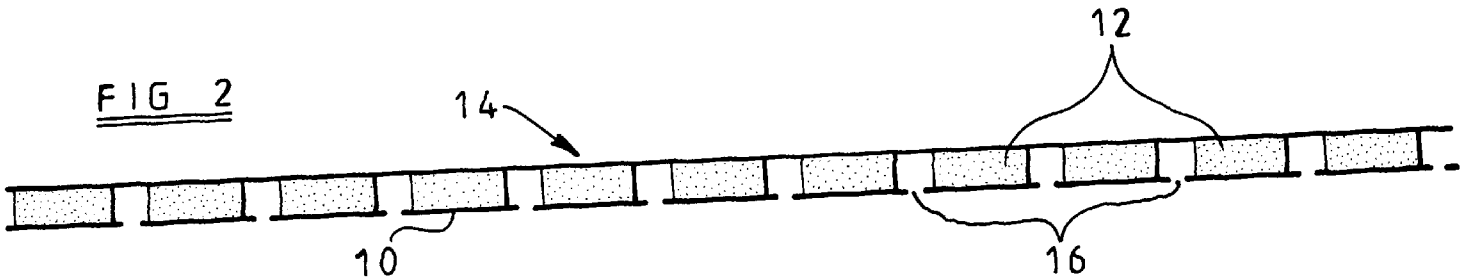
Figure 4:
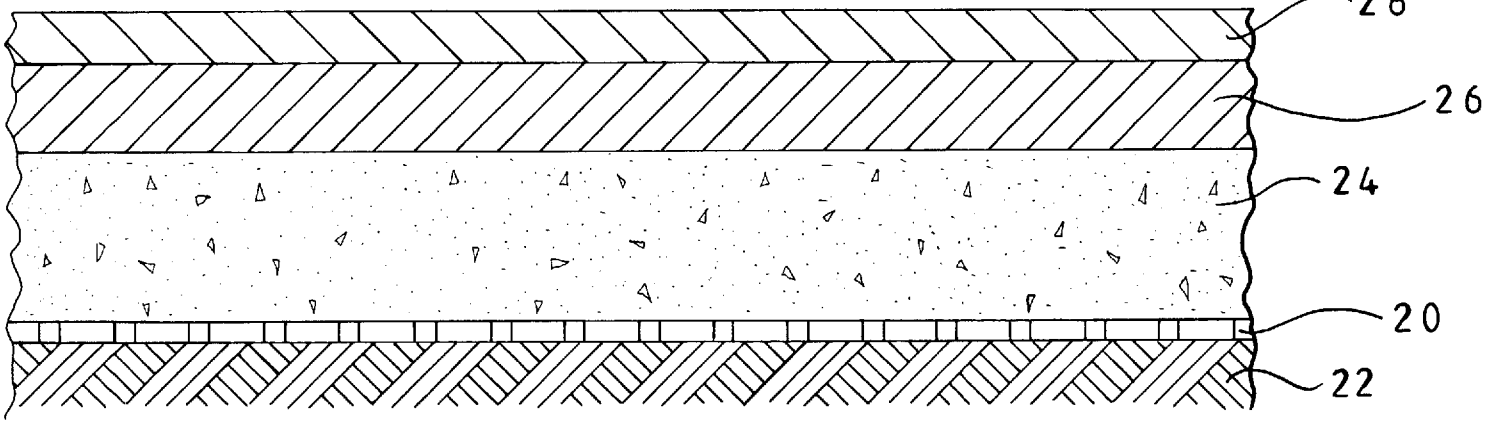
Figure 3:
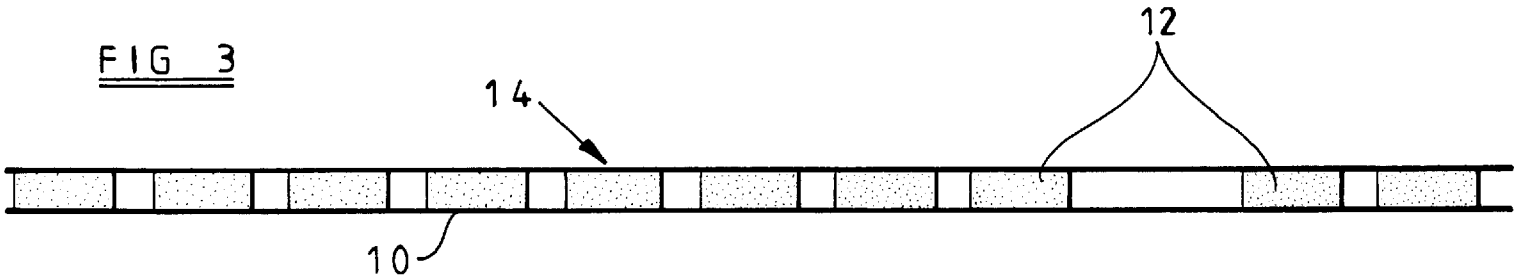

An embodiment of the present invention will now be described, by way of example, with reference to the accompanying drawings, in which:

FIG. 1 is a plan view of a layer structure according to the present invention shown without an upper flexible sheet material, FIG. 2 is a section on the line A—A of the structure of FIG. 1 but with upper flexible sheet material, FIG. 3 is a view similar to FIG. 2 of another embodiment, and FIG. 4 is a cross-section of a highway pavement incorporating the layer structure of FIGS. 1 and 2.

Referring now to FIGS. 1 and 2 of the drawings, the layer structure comprises a lower flexible sheet material 10, a load spreading layer formed of a multiplicity of load-spreading circular disks 12, and an upper flexible sheet material 14 (only shown in FIG. 2).

The load-spreading disks 12 are arranged in spaced apart relationship so that, except at the edges of the structure, each disk 12 is surrounded by six other disks 12. The spacing between the disks 12 is equal, in this embodiment the minimum spacing between adjacent disks 12 being 5 mm. In this particular embodiment, each disk 12 has a diameter of 13 mm and a thickness of 5 mm and is formed of a suitable resin material, in this example pvc.

The disks 12 are bonded by means of an adhesive (or by a melt bonding operation) to the lower flexible sheet material 10 which, in this embodiment, is formed of pvc having a thickness of between 0.3 mm and 1.5 mm typically 0.75 mm. The lower flexible sheet material 10 is water impermeable but is provided with a multiplicity of circular perforations 16 therethrough which are disposed in the gaps between the disks 12 so that each perforation 16 is equidistantly spaced from three surrounding disks 12. In this embodiment, each perforation has a diameter of 2.5 mm and is spaced from the surrounding disks 12 by a distance of 3 mm.

The upper flexible sheet material 14 is, in this embodiment, formed of a water-permeable synthetic plastics (e.g, polypropylene, polyester or pvc) textile material having a similar thickness to that of the material 10. The upper flexible sheet material 14 is bonded at intervals to the top surfaces of some or all of the disks 12 so as to fix the sheet material 14 in position to facilitate handling of the layer structure. The upper flexible sheet material 14 may be extensible.

In use, the resultant layer structure (indicated by arrow 20 in FIG. 4) is incorporated in a flexible highway pavement which is formed on a subgrade 22. In this embodiment, the flexible highway pavement comprises sub-base 24 which is provided directly over the layer structure 20, base course 26 formed on the sub-base 24, and wearing course 28 formed on the base course 26 and providing the upper layer of the highway pavement. The layer structure 20 acts, in use, in the manner described hereinbefore.

Referring now to FIG. 3, the layer structure illustrated therein is similar to that of FIG. 2 except that, in this embodiment, the lower flexible sheet material is completely impermeable to both liquid water and water vapour and is completely unperforated. The upper flexible sheet material 14, in this embodiment, is bonded at intervals to the top surfaces of some or all of the disks 12, but in other embodiments, is not bonded thereto but merely laid over the disks 12 during construction of the pavement. In other embodiments, the upper flexible sheet may be absent. Although FIG. 4 relates to a highway pavement, the layer structures of FIGS. 1 and 2 and of FIG. 3 are also suitable for use in the construction of railway pavements where it is ideally incorporated between the ballast and the subgrade.

We claim:

1. A method of constructing a pavement on a subgrade comprising the steps of:

providing on the subgrade a multi-layer structure comprising upper and lower flexible sheet materials and an intermediate load-spreading layer between said upper and lower flexible sheet materials, said loading-spreading layer including a multiplicity of load-spreading elements which are held together in a preset arrangement so that gaps are provided between adjacent load-spreading elements for passage of water and to permit said load-spreading layer to flex, said upper flexible sheet material being water permeable, and said lower flexible sheet material being one of (a) substantially water impermeable, provided with perforations or slits, therethrough at locations which open into the gaps between the load-spreading elements, (b) water vapour permeable and substantially impermeable to liquid water, and (c) substantially impermeable to liquid water and water vapour; and layering a subbase or ballast on said multi-layer structure.

2. The method as claimed in claim 1, wherein the load-spreading elements have an area which lies within the range of 20–500 $mm^2$.

3. The method as claimed in claim 1, wherein the load-spreading elements have an area of 75–315 $mm^2$.

4. The method as claimed in claim 1, wherein the load-spreading elements have an area of about 110 to 185 $mm^2$.

5. The method as claimed 1, wherein the load-spreading elements are substantially circular in plan view.

6. The method as claimed in claim 5, wherein the load-spreading elements have a diameter of about 13 mm.

7. The method as claimed in claim 1, wherein the load-spreading elements have a thickness of about 2 to 5 mm.

8. The method as claimed in claim 1, wherein the spacing between adjacent load-spreading elements is about 2 to 5 mm.

9. The method as claimed in claim 1, wherein the load-spreading elements are held together in the desired pre-set arrangement by being bonded or otherwise secured to the lower flexible sheet material.

10. A layer structure for use at the interface between a pavement subbase or ballast and a subgrade, said layer structure comprising a lower flexible sheet material having an intermediate load-spreading layer fixed thereto, said load-spreading layer including a multiplicity of load-spreading elements which are held together in a preset arrangement so that gaps are provided between adjacent load-spreading elements for passage of water and to permit said load-spreading layer to flex, and said lower flexible sheet material being one of (a) substantially water impermeable, provided with perforations or slits therethrough at locations which open into the gaps between the load-spreading elements, (b) water vapour permeable, and substantially impermeable to liquid water, and (c) substantially impermeable to liquid water and water vapour, and an upper flexible sheet material fixed to the load-spreading layer and being water permeable.

* * * * *